US008580054B2

(12) United States Patent
Pagoria et al.

(10) Patent No.: US 8,580,054 B2
(45) Date of Patent: Nov. 12, 2013

(54) MELT-CASTABLE ENERGETIC COMPOUNDS COMPRISING OXADIAZOLES AND METHODS OF PRODUCTION THEREOF

(75) Inventors: Philip F. Pagoria, Livermore, CA (US); Mao X. Zhang, Mountain House, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 0 days.

(21) Appl. No.: 13/439,780

(22) Filed: Apr. 4, 2012

(65) Prior Publication Data

US 2013/0263982 A1 Oct. 10, 2013

(51) Int. Cl.

| | |
|---|---|
| ***C06B 25/00*** | (2006.01) |
| ***C06B 25/34*** | (2006.01) |
| ***D03D 23/00*** | (2006.01) |
| ***D03D 43/00*** | (2006.01) |

(52) U.S. Cl.
USPC ..... 149/92; 149/88; 149/108.2; 149/109.2; 149/109.4; 149/109.6

(58) Field of Classification Search
USPC ..... 149/88, 92, 108.2, 109.2, 109.4, 109.6
See application file for complete search history.

(56) References Cited

U.S. PATENT DOCUMENTS

| | | | | |
|---|---|---|---|---|
| 3,116,417 | A * | 12/1963 | Orr et al. | 250/264 |
| 3,817,633 | A | 6/1974 | White | |
| 4,482,808 | A * | 11/1984 | Tominaga et al. | 250/392 |
| 4,692,266 | A * | 9/1987 | Costa et al. | 252/301.17 |
| 4,957,114 | A | 9/1990 | Zeng et al. | |
| 5,042,494 | A | 8/1991 | Alfano | |
| 5,131,398 | A | 7/1992 | Alfano et al. | |
| 5,261,410 | A | 11/1993 | Alfano et al. | |
| 5,313,306 | A | 5/1994 | Kuban et al. | |
| 5,348,018 | A | 9/1994 | Alfano et al. | |
| 5,467,767 | A | 11/1995 | Alfano et al. | |
| 5,593,879 | A | 1/1997 | Steller et al. | |
| 5,769,081 | A | 6/1998 | Alfano et al. | |
| 5,833,596 | A | 11/1998 | Bonnell et al. | |
| 5,847,394 | A | 12/1998 | Alfano et al. | |
| 5,976,076 | A | 11/1999 | Kolff et al. | |
| 5,997,472 | A | 12/1999 | Bonnell et al. | |
| 6,169,289 | B1 | 1/2001 | White et al. | |
| 6,269,169 | B1 | 7/2001 | Funk et al. | |
| 6,413,267 | B1 | 7/2002 | Dumoulin-White et al. | |

(Continued)

FOREIGN PATENT DOCUMENTS

EP 0 352 952 A2 1/1990

OTHER PUBLICATIONS

Restriction/Election Requirement from U.S. Appl. No. 12/167,104 dated Jun. 8, 2011.

(Continued)

*Primary Examiner* — James McDonough
(74) *Attorney, Agent, or Firm* — Dominic M. Kotab

(57) ABSTRACT

In one embodiment, a melt-castable energetic material comprises at least one of: 3,5-bis(4-nitro-1,2,5-oxadiazol-3-yl)-1,2,4-oxadiazole (DNFO), and 3-(4-amino-1,2,5-oxadiazol-3-yl)-5-(4-nitro-1,2,5-oxadiazol-3-yl)-1,2,4-oxadiazole (ANFO). In another embodiment, a method for forming a melt-castable energetic material includes reacting 3,5-bis(4-amino-1,2,5-oxadiazol-3-yl)-1,2,4-oxadiazole (DAFO) with oxygen or an oxygen-containing compound to form a mixture of at least: DNFO, and ANFO.

18 Claims, 4 Drawing Sheets

(56) References Cited

U.S. PATENT DOCUMENTS

| | | | | |
|---|---|---|---|---|
| 6,462,770 | B1 | 10/2002 | Cline et al. | |
| 6,477,403 | B1 | 11/2002 | Eguchi et al. | |
| 6,529,769 | B2 | 3/2003 | Zigler | |
| 6,687,000 | B1 | 2/2004 | White | |
| 6,730,019 | B2 | 5/2004 | Irion | |
| 6,775,567 | B2 | 8/2004 | Cable et al. | |
| 6,949,069 | B2 | 9/2005 | Farkas et al. | |
| 6,975,898 | B2 | 12/2005 | Seibel | |
| 6,975,899 | B2 | 12/2005 | Faupel et al. | |
| 7,003,147 | B2 | 2/2006 | Inoue | |
| 7,016,717 | B2 | 3/2006 | Demos et al. | |
| 7,172,553 | B2 | 2/2007 | Ueno et al. | |
| 7,257,437 | B2 | 8/2007 | Demos et al. | |
| 7,930,516 | B1 | 4/2011 | Jin et al. | |
| 7,945,077 | B2 | 5/2011 | Demos | |
| 8,207,507 | B2 * | 6/2012 | Zaitseva et al. | 250/390.11 |
| 8,461,546 | B2 | 6/2013 | Payne et al. | |
| 2001/0030744 | A1 | 10/2001 | Chang | |
| 2003/0158470 | A1 | 8/2003 | Wolters et al. | |
| 2003/0232445 | A1 | 12/2003 | Fulghum, Jr. | |
| 2005/0020926 | A1 | 1/2005 | Wiklof et al. | |
| 2006/0086311 | A1 * | 4/2006 | Zagumennyi et al. | 117/13 |
| 2007/0175383 | A1 * | 8/2007 | Fukuda et al. | 117/35 |
| 2008/0267472 | A1 | 10/2008 | Demos | |
| 2012/0326042 | A1 | 12/2012 | Zaitseva et al. | |

OTHER PUBLICATIONS

Non-Final Office Action from U.S. Appl. No. 12/167,104 dated Sep. 15, 2011.

Final Office Action from U.S. Appl. No. 12/167,104 dated Feb. 23, 2012.

Notice of Allowance and Fee(s) Due from U.S. Appl. No. 12/167,104 dated Jun. 21, 2012.

Udagawa et al., "Aberrant Porphyrin Metabolism in Hepatocellular Carcinoma," 1984 Academic Press, Inc., Biochemical Medicine, vol. 31, pp. 131-139.

Pitts et al., "Autofluorescene characteristics of immortalized and carcinogen-transformed human bronchial epithelial cells," 2001 SPIE, Journal of Biomedical Optics, vol. 6, No. 1, Jan. 2001, pp. 31-40.

Zawirska, B., "Comparative Porphyrin Content in Tumors with Contiguous Non-Neoplastic Tissues," 1979, Neoplasma, vol. 26, No. 2, pp. 223-229.

Malik et al., "Destruction of Erythroleukaemic Cells by Photoactivation of Endogenous Porphyrins," The Macmillan Press Ltd., 1987, Br. J. Cancer, 1987, vol. 56, pp. 589-595.

Zhang et al., "Far-red and NIR Spectral Wing Emission from Tissues under 532 and 632 nm Photo-excitation," 1999 OPA, Lasers in the Life Sciences, vol. 9, pp. 1-16.

Alfano et al., "Laser Induced Fluorescence Spectroscopy from Native Cancerous and Normal Tissue," 1984 IEEE, IEEE Journal of Quantum Electronics, vol. QE-20, No. 12, Dec. 1984, pp. 1507-1511.

Navone et al., "Heme Biosynthesis in Human Breast Cancer-Mimetic "In Vitro" Studies and Some Heme Enzymic Activity Levels," 1990 Pergamon Press Pic, International Journal on Biochemistry, vol. 22, No. 12, pp. 1407-1411.

Richards-Kortum et al., "Spectroscopic Diagnosis of Colonic Dysplasia," 1991 Pergamon Press Pic, Photochemistry and Photobiology, vol. 53, No. 6, pp. 777-786.

Demos et al., "Subsurface Imaging Using the Spectral Polarization Difference Technique and NIR Illumination," Part of the SPIE Conference on Optical Tomography and Spectroscopy of Tissue III, Jan. 1991, SPIE 3597, pp. 406-410.

Demos et al., "Tissue Imaging for Cancer Detection Using NIR Autofluorescence," 2002 SPIE, Optical Biopsy IV, Proceedings of SPIE, vol. 4613, pp. 31-34.

Corle et al., "Chapter 2—Instruments," Confocal Scanning Optical Microscopy and Related Imaging Systems, 1996, pp. 67-145.

U.S. Appl. No. 13/742,298, filed Jan. 15, 2013.

U.S. Appl. No. 13/471,259, filed May 14, 2012.

U.S. Appl. No. 13/601,918, filed Aug. 31, 2012.

U.S. Appl. No. 13/437,836, filed Apr. 2, 2012.

Peurrung, A. J., "Recent developments in neutron detection," 2000 Elsevier Science B.V., Nuclear Instruments and Methods in Physics Research A, vol. 443, 2000, pp. 400-415.

Brooks, F. D., "Development of Organic Scintillators," North-Holland Publishing Co., Nuclear Instruments and Methods, vol. 162, 1979, pp. 477-505.

Vijayan et al., "Growth, optical, thermal and mechanical studies of methyl 4-hydroxybenzoate single crystals," 2003 Elsevier B.V., Journal of Crystal Growth, vol. 256, 2003, pp. 174-182.

Varfolomeeva, V. N., et al., "Polarization Diagrams for the Fluorescence of Single Crystals of Salicylic Acid and Salicylates," Soviet Physics—Crystallography, vol. 13, No. 2, Sep.-Oct. 1968, pp. 209-211.

Mandshukov, I. G., et al., "Properties of a New Class of Organic Scintillators: Derivatives of Salicyclic Acid," 1982 Plenum Publishing Corporation, University of Sofia, Bulgaria, Translated from Pribory i Tekhnika Eksperimenta, No. 3, May-Jun. 1981, pp. 605-611.

Zhao et al., "Characteristics of large-sized Ce:YAG Scintillation crystal grown by temperature gradient technique," 2003 Elsevier B.V., Journal of Crystal Growth, vol. 253, 2003, pp. 290-296.

Non-Final Office Action from U.S. Appl. No. 12/418,434 dated May 20, 2011.

Non-Final Office Action from U.S. Appl. No. 12/418,434 dated Nov. 22, 2011.

Notice of Allowance and Fee(s) Due from U.S. Appl. No. 12/418,434 dated Feb. 23, 2012.

Non-Final Office Action from U.S. Appl. No. 12/418,450 dated Jul. 13, 2011.

Non-Final Office Action from U.S. Appl. No. 12/418,450 dated Nov. 15, 2011.

Final Office Action from U.S. Appl. No. 12/418,450 dated Feb. 24, 2012.

Notice of Allowance and Fee(s) Due from U.S. Appl. No. 12/418,450 dated Oct. 22, 2012.

Andrianov et al., "Synthesis and Properties of 4-Amino-3-Cyanofurazan," 1994 Plenum Publishing Corporation, Chemistry of Heterocyclic Compounds, vol. 30, No. 5, 1994, pp. 608-611.

Shaposhnikov et al., "New Heterocycles with a 3-Aminofurazanyl Substituent," 2002 MAIK, Russian Journal of Organic Chemistry, vol. 38, No. 9, 2002, pp. 1351-1355.

Yarovenko et al., "15N NMR study of the mechanism of the reaction of amidoximes with nitriles in the presence of ZnCl2 and HCI," 1995 Plenum Publishing Corporation, Russian Chemical Bulletin, vol. 43, No. 4, Apr. 1994, pp. 627-629.

Yarovenko et al., "A convenient synthesis of 3-substituted 5-guanidino-1, 2, 4-Oxadiazoles," 1994 Plenum Publishing Corporation, Russian Chemical Bulletin, vol. 43, No. 1, Jan. 1994, pp. 114-117.

Yarovenko et al., "Synthesis of 2-amino-5-(5R-1,2,4-Oxadiazolyl-3)-1,3,4-Oxadiazoles," 1994 Plenum Publishing Corporation, Russian Chemical Bulletin, vol. 42, No. 12, Dec. 1993, pp. 2014-2017.

Yarovenko et al., "New Synthesis of 1,2,4-Oxadiazoles," Tetrahedron, vol. 46, No. 11, 1990, pp. 3941-3952.

Non-Final Office Action from U.S. Appl. No. 13/736,898 dated Mar. 8, 2013.

* cited by examiner

MELT-CASTABLE ENERGETIC COMPOUNDS COMPRISING OXADIAZOLES AND METHODS OF PRODUCTION THEREOF

The United States Government has rights in this invention pursuant to Contract No. DE-AC52-07NA27344 between the United States Department of Energy and Lawrence Livermore National Security, LLC for the operation of Lawrence Livermore National Laboratory.

FIELD OF THE INVENTION

The present invention relates to energetic compounds, and more particularly, to insensitive melt-castable energetic compounds and propellants having oxadiazoles.

BACKGROUND

Insensitive highly energetic compounds are very useful materials which may be used in a number of different applications, including explosives, propellants, weapons, etc. Trinitrotoluene (TNT) and 1,3,5-triamino-2,4,6-trinitrobenzene (TATB) are examples of common insensitive highly energetic compounds, which may take any desired form, and may be activated/detonated using an initiator, such as a blasting cap, an electrical signal, etc.

Castable energetic compounds are generally classified as either melt-castable or cast-cured. Melt-castable systems include those in which the energetic compound may be melted and cast into a munition. Cast-cured systems involve a mixture of one or more energetic compounds with a polymeric binder, cross-linker, plasticizer, and catalyst that is cast into a munition and allowed to cure in place. Both of these approaches are useful when using insensitive highly energetic compounds to prepare them for use as weapons/explosives/propellants.

Insensitive energetic compounds tend to be relatively stable, meaning that the energetic compounds will not explode easily in response to shock, fire, physical contact, etc. Instead, they preferably activate/detonate in response to an intended initiation.

SUMMARY

In one embodiment, a melt-castable energetic material comprises at least one of: 3,5-bis(4-nitro-1,2,5-oxadiazol-3-yl)-1,2,4-oxadiazole (DNFO), and 3-(4-amino-1,2,5-oxadiazol-3-yl)-5-(4-nitro-1,2,5-oxadiazol-3-yl)-1,2,4-oxadiazole (ANFO), wherein DNFO has a chemical structure of:

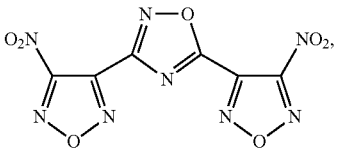

and wherein ANFO has a chemical structure of:

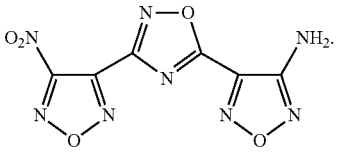

In another embodiment, a method for forming a melt-castable energetic material includes reacting 3,5-bis(4-amino-1,2,5-oxadiazol-3-yl)-1,2,4-oxadiazole (DAFO) with oxygen or an oxygen-containing compound to form a mixture of at least: DNFO, and ANFO, wherein DAFO has a chemical structure of:

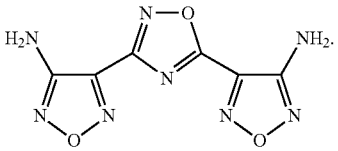

Other aspects and embodiments of the present invention will become apparent from the following detailed description, which, when taken in conjunction with the drawings, illustrate by way of example the principles of the invention.

DETAILED DESCRIPTION

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defused herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an," and "the" include plural referents unless otherwise specified.

In one general embodiment, a melt-castable energetic material comprises at least one of: 3,5-bis(4-nitro-1,2,5-oxadiazol-3-yl)-1,2,4-oxadiazole (DNFO), and 3-(4-amino-1,2,5-oxadiazol-3-yl)-5-(4-nitro-1,2,5-oxadiazol-3-yl)-1,2,4-oxadiazole (ANFO), wherein DNFO has a chemical structure of:

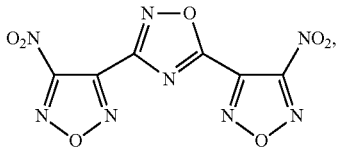

and wherein ANFO has a chemical structure of:

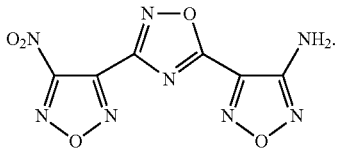

In another general embodiment, a method for forming a melt-castable energetic material includes reacting 3,5-bis(4-amino-1,2,5-oxadiazol-3-yl)-1,2,4-oxadiazole (DAFO) with oxygen or an oxygen-containing compound to form a mixture of at least: DNFO, and ANFO, wherein DAFO has a chemical structure of:

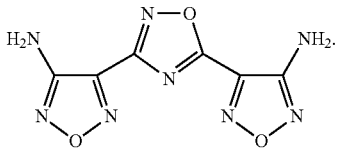

According to one embodiment, a mixture of DNFO and ANFO may be produced through a reaction of DAFO. DAFO may be produced through a reaction of 4-amino-1,2,5-oxadiazole-3-carboxamidoxime (AOCA) and 3-amino-4-cyano-1,2,5-oxadiazole (ACOD), the latter possibly being formed by reacting AOCA with $PbO_2$ in the presence of acetic acid.

Figure 1:
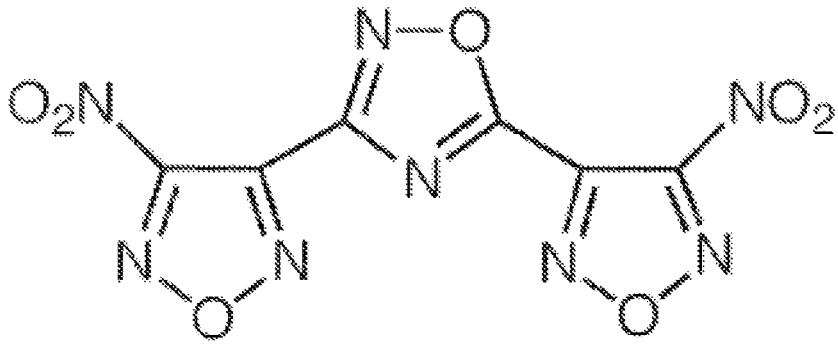
FIG. 1 shows a chemical structure of 3,5-bis(4-nitro-1,2,5-oxadiazol-3-yl)-1,2,4-oxadiazole (DNFO), according to one embodiment.
Figure 2:
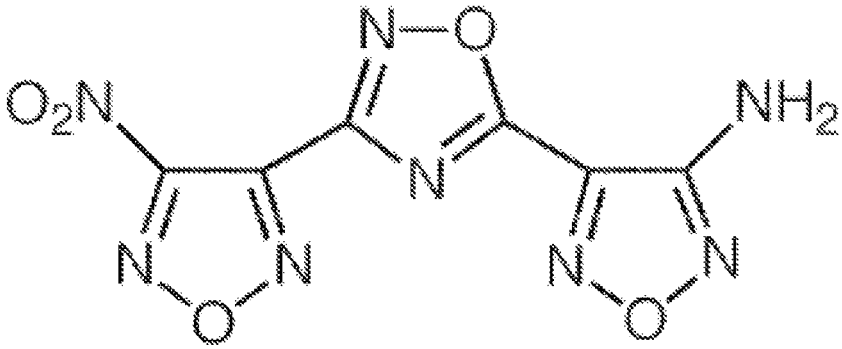
FIG. 2 shows a chemical structure of 3-(4-amino-1,2,5-oxadiazol-3-yl)-5-(4-nitro-1,2,5-oxadiazol-3-yl)-1,2,4-oxadiazole (ANFO), according to one embodiment.

In one embodiment, a melt-castable energetic material comprises at least one of DNFO and ANFO. DNFO has a chemical structure, according to one embodiment, as shown in FIG. 1. ANFO has a chemical structure, in one embodiment, as shown in FIG. 2.

According to one approach, the melt-castable energetic material may include both ANFO and DNFO, in a predetermined ratio, as formed from the production method, or according to some other criteria or determination, such as being selected to provide a desired detonation characteristic, burn rate, etc.

In another approach, the melt-castable energetic material may further comprise a metal, such as a zero valence metal, the inclusion of which enhances the release of energy upon detonation. In one preferred approach, the metal may be selected from a group consisting of: aluminum, boron, and magnesium. Of course, other suitable metals may be used as would be understood by one of skill in the art upon reading the present descriptions.

Figure 3:
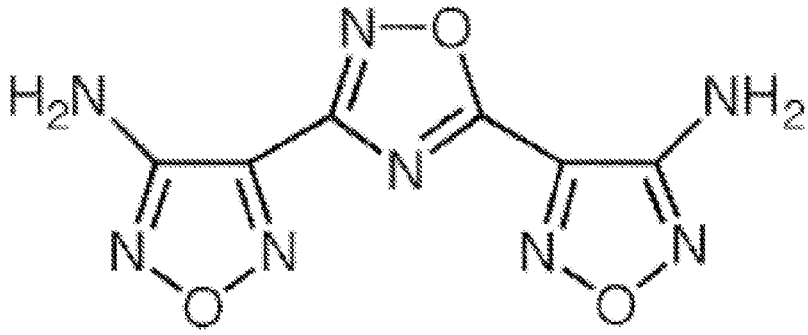
FIG. 3 shows a chemical structure of 3,5-bis(4-amino-1,2,5-oxadiazol-3-yl)-1,2,4-oxadiazole (DAFO), according to one embodiment.

In one embodiment, a precursor material for producing a melt-castable energetic material (such as one which comprises DNFO and/or ANFO) comprises DAFO According to one approach, DAFO has a chemical structure as shown in FIG. 3.

Figure 4:
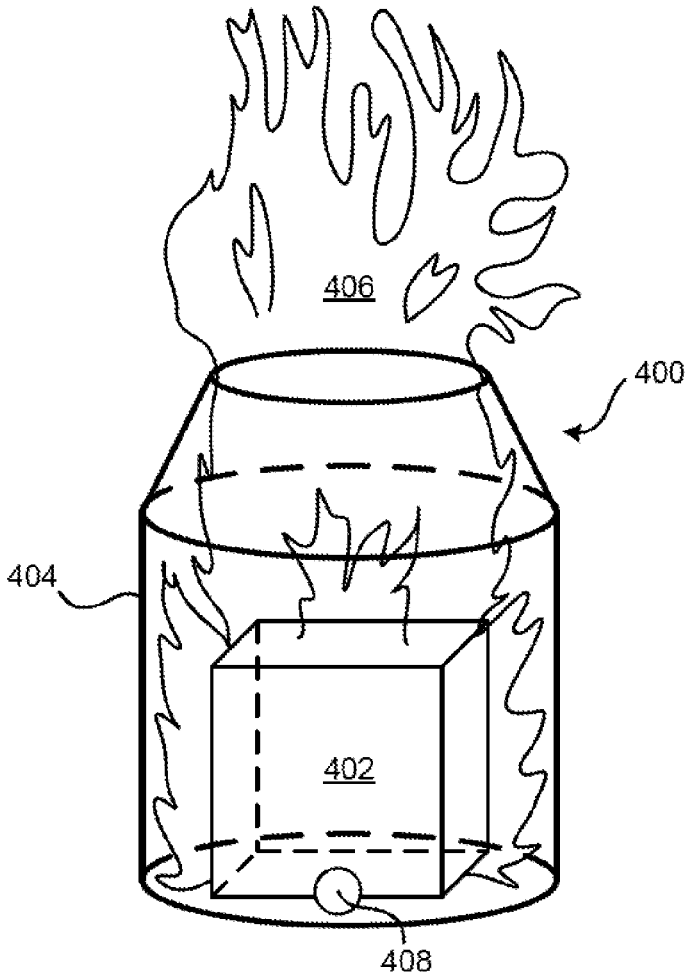
FIG. 4 shows a simplified diagram of an article, according to one embodiment.

As shown in FIG. 4, in another embodiment, an article 400 comprises a housing 404 for directing an explosion 406 and a melt-castable energetic material 402 for providing the explosion 406. The melt-castable energetic material 402 may comprise DNFO and/or ANFO, in one approach. The housing and the melt-castable energetic material may take any desired form or shape, and are not limited by the shapes shown in FIG. 4. In addition, in some approaches, a mechanism 408 for triggering, initiating, detonating, and/or activating the melt-castable energetic material 402 may be included in the article 400.

In a further embodiment, the melt-castable energetic material 402 may further comprise a zero valence metal, such as aluminum, boron, magnesium, etc. to enhance the release of energy.

Figure 5:
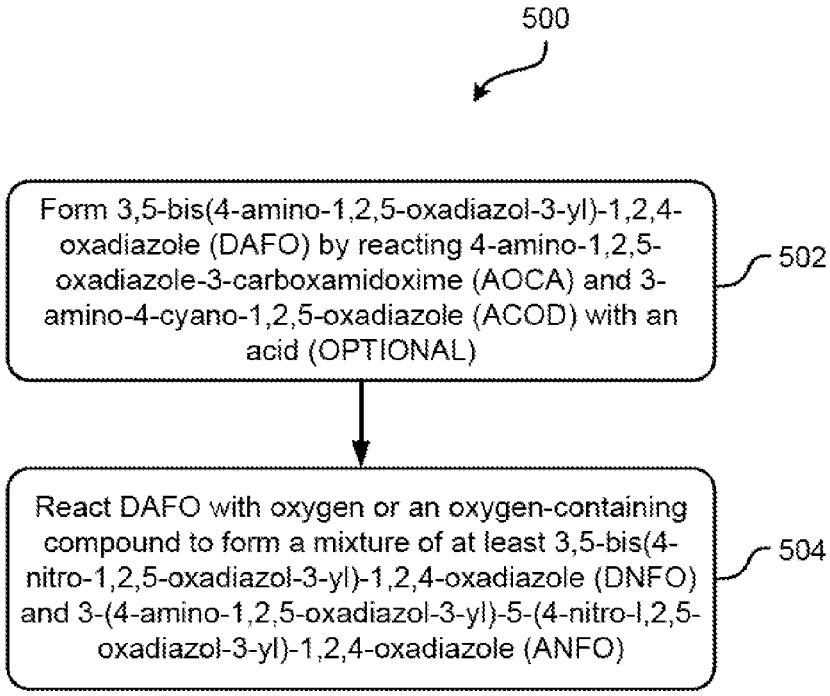
FIG. 5 is a flow diagram of a method according to one embodiment.

Now referring to FIG. 5, a method 500 for forming a melt-castable energetic material is shown according to one embodiment. The method 500 may be carried out in any desired environment, including those described herein. Also, the method 500 may include more or less operations than those described in FIG. 5, as would be understood by one of skill in the art upon reading the present descriptions.

In operation 504, 3,5-bis(4-amino-1,2,5-oxadiazol-3-yl)-1,2,4-oxadiazole (DAFO) is reacted with oxygen or an oxygen-containing compound to form a mixture of at least 3,5-bis(4-nitro-1,2,5-oxadiazol-3-yl)-1,2,4-oxadiazole (DNFO) and 3-(4-amino-1,2,5-oxadiazol-3-yl)-5-(4-nitro-1,2,5-oxadiazol-3-yl)-1,2,4-oxadiazole (ANFO). The DNFO, ANFO, and DAFO have chemical structures as shown in FIGS. 1, 2, and 3, respectively.

Figure 6:
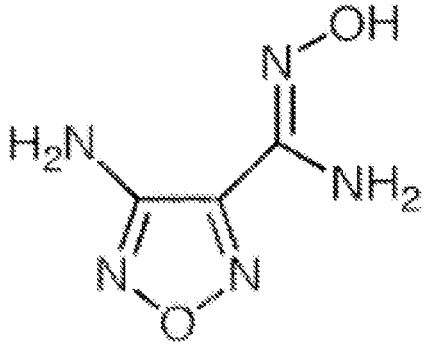
FIG. 6 shows a chemical structure of 4-amino-1,2,5-oxadiazole-3-carboxamidoxime (AOCA), according to one embodiment.
Figure 7:
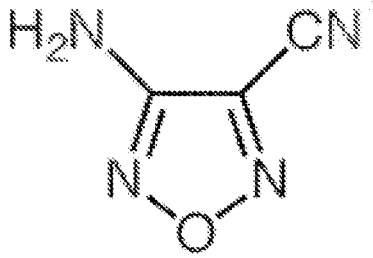
FIG. 7 shows a chemical structure of 3-amino-4-cyano-1,2,5-oxadiazole (ACOD), according to one embodiment.

Referring again to FIG. 5, in optional operation 502, DAFO is formed by reacting 4-amino-1,2,5-oxadiazole-3-carboxamidoxime (AOCA) and 3-amino-4-cyano-1,2,5-oxadiazole (ACOD) with a Lewis acid. In one approach, AOCA has a chemical structure as shown in FIG. 6. In another approach, ACOD has a chemical structure as shown in FIG. 7. In a further embodiment, the Lewis acid may comprise zinc chloride ($ZnCl_2$) or any other suitable Lewis acid as would be known by one of skill in the art.

According to one embodiment, the reacting with oxygen of operation 504 may comprise mixing DAFO with a solvent and adding a 50%-90% hydrogen peroxide ($H_2O_2$) solution to the DAFO and the solvent to form a reaction solution. The hydrogen peroxide or some other suitable oxidant may be added dropwise or in some other slow, controlled fashion, in order to control the reaction rate and temperature to avoid a Runway reaction. The solvent, in some approaches, may be trifluoroacetic acid (TFA), sulfuric acid, or any other suitable solvent. The mixing may be performed using a stirrer, agitator, etc., in a flask, beaker, reaction vessel, etc., as would be understood by one of skill in the art.

In this embodiment, the reaction solution may be cooled to maintain a temperature of less than about 50° C. while stirring the reaction solution for a period of at least 8 hours.

Furthermore, in this embodiment, at least one of the DNFO and the ANFO may be extracted using an organic solvent. Any organic solvent and any extraction method may be used, as would be known by one of skill in the art upon reading the present descriptions. In one embodiment, the organic solvent may comprise at least one of: methylene chloride, toluene ($C_6H_5CH_3$), ether ($CH_3$—$CH_2$—O—$CH_2$—$CH_3$ or R—O—

R', wherein R and R' are an alkyl group or an aryl group), and ethyl acetate ($CH_3COOCH_2CH_3$).

Moreover, in this embodiment, the DNFO may be purified using short column chromatography while eluting with a methylene chloride ($CH_2Cl_2$) and pentane ($C_5H_{12}$) solution in about a 2:3 ratio, in one approach. Of course, any other separation method may be used as would be known to one of skill in the art upon reading the present descriptions.

In addition, in this embodiment, the ANFO may be separated using short column chromatography while eluting with methylene chloride. Of course, any other separation method may be used as would be known to one of skill in the art upon reading the present descriptions.

Also, in this embodiment, the DNFO may be purified using at least one of: vacuum sublimation and recrystallization from chloroform ($CHCl_3$). Of course, any other purification method may be used as would be known to one of skill in the art upon reading the present descriptions. The DNFO may be purified using any method, such as vacuum sublimation and/or recrystallization according to various embodiments.

Additionally, in this embodiment, the ANFO may be purified using recrystallization from ethanol ($C_2H_5OH$). Of course, any other purification method may be used as would be known to one of skill in the art upon reading the present descriptions.

In another embodiment, the reacting with oxygen of operation 504 may comprise suspending DAFO in an acid. Any suitable acid may be used as would be known by one of skill in the art, such as TFA, sulfuric acid, etc. Then, a 50%-90% hydrogen peroxide solution is added in a slow, controlled way (e.g., dropwise) to the DAFO and the acid to form a reaction solution.

In this embodiment, the reaction solution may be cooled to maintain a temperature of less than about 50° C. while stirring the reaction solution for a period of at least 8 hours.

Also, in this embodiment, the reaction solution may be added to water at a temperature of less than about 5° C., at least one of the DNFO and the ANFO may be extracted using methylene chloride to provide a product, the product may be washed with water, the product may be dried over sodium sulfate (or some other suitable drying agent), solvent may be removed from the product using a rotary evaporator (or some other suitable removal method), and the DNFO and/or ANFO may be separated using column chromatography while eluting with methylene chloride.

In another embodiment, the reacting with oxygen of operation 504 may further comprise adding a zero valence metal to the mixture such that at least one of the DNFO and the ANFO becomes metal-loaded.

In any of the following experimental descriptions, weights, volumes, sizes, temperatures, and times described in the experiments are descriptions of actual conditions, and not meant to be limiting on the invention in any manner. Of course, more or less of any or each of the reactants may be used, temperatures may be changed, reaction times may be altered, etc., as would be understood by one of skill in the art upon reading the present descriptions.

According to one embodiment, AOCA may be prepared using the following reaction sequence or modification thereof, as would be understood by one of skill in the art upon reading the present descriptions.

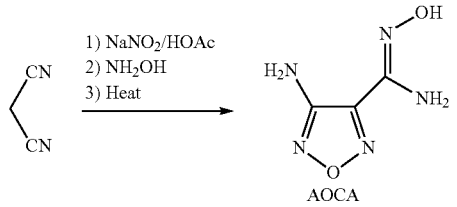

In this reaction sequence, according to one specific experiment, while stirring, sodium nitrite ($NaNO_2$, 55.0 g, 0.80 mol) was added to a mixture of malononitrile (50 g, 0.76 mol) in 80 ml of water at room temperature. Moreover, any suitable material may be used in place of or in addition to sodium nitrite as would be understood to one of skill in the art upon reading the present descriptions. After stirring for about 15 minutes, the mixture was cooled to about 0-5° C. with an ice-water cooling bath. Acetic acid ($CH_3COOH$(HOAc), 45.5 g, 0.76 mol) was then added slowly dropwise (one drop at a time) while maintaining the temperature at less than about 15° C. Special care was taken in the beginning of the addition process because initially the reaction is very exothermic. After the addition of acetic acid was complete, the reaction mixture was stirred on the cooling bath for about 1 hour and allowed to warm up to room temperature overnight. Of course, other suitable materials may be used in place of or in addition to acetic acid as would be understood by one of skill in the art upon reading the present descriptions.

With cooling from a cool water bath (about 10-15° C.) a 10% sodium hydroxide (NaOH, 200 ml) aqueous solution was added dropwise to the reaction mixture while maintaining the temperature at less than about 20° C. At less than about 20° C., a 50% hydroxylamine aqueous solution ($NH_2OH$, 113 g, 1.71 mol, diluted with 100 ml of water) was added slowly. After the addition of sodium hydroxide was completed, the mixture was stirred while maintaining a temperature of less than about 20° C. for about 1 hour. Of course, other suitable materials may be used in place of or in addition to sodium hydroxide and hydroxylamine as would be understood by one of skill in the art upon reading the present descriptions.

The mixture was heated slowly to reflux while adjusting the pH to about 9-10 by addition of glacial acetic acid. The solution, now orange in color, was refluxed for about 2 hours and allowed to cool to room temperature. The precipitate was collected by filtration, washed with water, and dried to provide AOCA (85.1 g, 79%); m.p. 182-185° C.; $^1$HNMR (DMSO-$d_6$) δ 10.46 (s, 1H), 6.26 (s, 2H), 6.17 (s, 2H); $^{13}$CNMR (DMSO-$d_6$) δ 154.7, 144.3, 140.3.

According to one embodiment, ACOD may be prepared using the following reaction sequence or modification thereof, as would be understood by one of skill in the art upon reading the present descriptions.

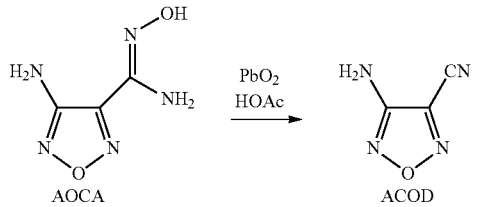

In this reaction sequence, according to one specific experiment, AOCA (37 g, 0.26 mol) was suspended in 160 ml of acetic acid. While stirring and cooling using a cool water bath (about 19-20° C.), lead dioxide ($PbO_2$, 57 g, 0.24 mol) was added in small portions using a solid addition funnel, controlling the reaction temperature between about 20-30° C. When the addition was completed, the reaction mixture was heated for about 3 hours and maintained at a temperature of about 40° C. The reaction mixture was allowed to cool to room temperature and filtered through a bed of CELITE to remove insoluble by-products. Of course, any suitable materials may be used in place of or in addition to lead dioxide, acetic acid, and/or CELITE, as would be understood by one of skill in the art upon reading the present descriptions.

The filtrate was concentrated using a rotary evaporator and the resulting residue was stirred with ice-water (500 ml) and extracted with ethyl acetate ($CH_3COOCH_2CH_3$, 3 additions of 250 ml each, e.g., 3×250 ml). The combined organic phases were washed with brine, 10% aqueous sodium bicarbonate solution ($NaHCO_3$, 2×200 ml), brine (2×200 ml), and dried over sodium sulfate ($Na_2SO_4$). The solvent was removed under vacuum and the residue was stirred with 600 ml of methylene chloride ($CH_2Cl_2$) at room temperature for about 2 hours. Of course, any suitable materials may be used in place of or in addition to ethyl acetate, sodium bicarbonate, sodium sulfate, and/or methylene chloride, as would be understood by one of skill in the art upon reading the present descriptions.

The precipitate was removed by filtration and the filtrate was concentrated to yield ACOD (15.1 g, 53%); m.p. 83-85° C.; $^1$HNMR (DMSO-$d_6$) δ7.10; $^{13}$CNMR (DMSO-$d_6$) δ 158.3, 127.8, 109.8.

According to one embodiment, DAFO may be prepared using the following reaction sequence or modification thereof, as would be understood by one of skill in the art upon reading the present descriptions.

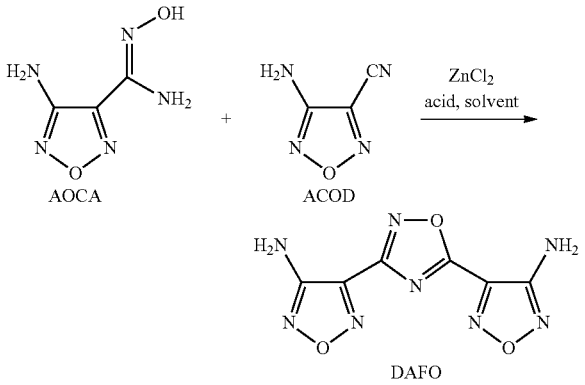

DAFO may be produced using any of various methods. In a first method (Method A), AOCA (0.63 mg, 4.40 mmol) and ACOD (0.56 mg, 4.40 mmol) were heated at about 170° C. for about 1 hour. The reaction mixture was allowed to cool to about room temperature, water (150 ml) was added to the mixture and the mixture was brought to reflux. The insoluble solid was removed by filtration and the filtrate was allowed to cool down to about room temperature. The precipitate was collected by suction filtration, washed using water, and dried to give DAFO (158 mg, 15%); m.p. 224-226° C.; $^1$HNMR (DMSO$d_6$) δ 6.86 (s, 2H), 6.68 (s, 2H); $^{13}$CNMR (DMSO-$d_6$) δ 166.8, 159.6, 155.9, 155.7, 136.6, 135.4. Of course, any suitable materials may be used in place of or in addition to the materials described in Method A, as would be understood by one of skill in the art upon reading the present descriptions.

In a first method (Method A), AOCA (0.63 mg, 4.40 mmol) and ACOD (0.56 mg, 4.40 mmol) were heated in 1,3-dimethoxybenzene at about 170° C. for about 4 hours in the presence of 2,4,6-trimethylpyridine (colidine). The reaction mixture was allowed to cool to about room temperature and hexane was added to precipitate the product. The precipitate was collected by suction filtration, washed using water, and dried to give DAFO (800 mg, 75%); m.p. 224-226° C.; $^1$HNMR (DMSO$d_6$) δ 6.86 (s, 2H), 6.68 (s, 2H); $^{13}$CNMR (DMSO-$d_6$) δ 166.8, 159.6, 155.9, 155.7, 136.6, 135.4. Of course, any suitable materials may be used in place of or in addition to the materials described in Method A, as would be understood by one of skill in the art upon reading the present descriptions.

In a second method (Method B), AOCA (0.25 g, 1.75 mmol) and ACOD (0.22 g, 2.0 mmol) were suspended in 10 ml of ethyl acetate. While vigorously stirring, zinc chloride (1.3 g, 9.53 mmol) was added in one portion at room temperature. While maintaining a temperature of less than about 30° C., gaseous hydrochloride acid (HCl) was bubbled into the mixture until a solution was realized. The reaction mixture was heated to reflux and held there for about 23 hours. The reaction mixture was allowed to cool down to room temperature and poured over ice-water (50 ml). The precipitate, now yellow in color, was collected by filtration and washed by water to yield crude DAFO (0.22 g). The crude product was heated in 10 ml of water at about 70° C. and filtered at temperature to produce substantially pure DAFO (0.16 g, 40%). Of course, any suitable materials may be used in place of or in addition to the materials described in Method B, as would be understood by one of skill in the art upon reading the present descriptions.

In a third method (Method C), AOCA (1.67 g, 11.7 mmol) and ACOD (1.93 g, 17.5 mmol) were suspended in 15 ml of butyl acetate ($C_6H_{12}O_2$). While vigorously stirring, zinc chloride (5.1 g, 37.4 mmol) was added in one portion at about room temperature. While maintaining a temperature of less than about 30° C., gaseous hydrogen chloride acid was bubbled into the mixture until a solution was realized. The reaction mixture was heated to reflux and held there for about 10 hour. The reaction mixture was allowed to cool to about room temperature, poured over ice-water (200 ml), and stirred for about 30 minutes. The precipitate, now having a yellow color, was collected by filtration and washed with water. The crude product was refluxed in water (20 ml), filtered at temperature, and the filtrate was allowed to cool. Collection of the precipitate using suction filtration provided DAFO (0.97 g, 35%). Of course, any suitable materials may be used in place of or in addition to the materials described in Method C, as would be understood by one of skill in the art upon reading the present descriptions.

In a fourth method (Method D), AOCA (1.0 g, 7.0 mmol), ACOD (1.0 g, 9.1 mmol), zinc chloride (1.01 g, 7.4 mmol), and p-toluenesulfonic acid monohydrate ($CH_3C_6H_4SO_2OH.H_2O$, 1.47 g, 7.7 mmol) were added to 6.0 ml of N,N-dimethylformamide (DMF) $(CH_3)_2NC(O)H$, at about room temperature. While vigorously stirring, the reaction mixture was heated in an oil-bath at about 120° C. for about 4 hours. The mixture was then cooled down to about room temperature and was poured over ice-water (50 ml). The precipitate was collected by filtration, washed by water, and dried to provide DAFO (0.7 g, 42%). Of course, any suitable materials may be used in place of or in addition to the materials described in Method D, as would be understood by one of skill in the art upon reading the present descriptions.

In another method (Method E), AOCA (2.0 g, 14.0 mmol), ACOD (2.0 g, 18.2 mmol), zinc chloride (2.5 g, 18.3 mmol), and p-toluenesulfonic acid monohydrate (1.5 g, 7.8 mmol) were added to 10 ml of DMF at room temperature. The mixture was heated in an oil-bath at about 120° C. for about 22 hours while stirring vigorously. The reaction mixture was allowed to cool to about room temperature and poured into ice-water (100 ml). The precipitate was collected by suction filtration, washed with water, and dried to provide DAFO (1.36 g, 41%). Of course, any suitable materials may be used in place of in addition to the materials described in Method E, as would be understood by one of skill in the art upon reading the present descriptions.

In another method (Method F), AOCA (0.15 g, 1.05 mmol), ACOD (0.35 g, 3.18 mmol), zinc chloride (0.47 g, 3.45 mmol), and p-toluenesulfonic acid monohydrate (0.20 g, 1.05 mmol) were added to 2.0 ml of butyl acetate at about room temperature. The mixture was heated in an oil-bath at about 120° C. for about 22 hours while stirring vigorously. The reaction mixture was allowed to cool to about room temperature and poured into ice-water (100 ml). The precipitate was collected by suction filtration, washed with water, and dried to provide DAFO (50 mg, 20%). Of course, any suitable materials may be used in place of or in addition to the materials described in Method F, as would be understood by one of skill in the art upon reading the present descriptions.

According to another method (Method G), AOCA (4.5 g, 31.5 mmol), ACOD (10.5 g, 95.4 mmol), zinc chloride (14.1 g, 103.5 mmol), and p-toluenesulfonic acid monohydrate (6.0 g, 31.5 mmol) were added to 35 ml of butyl acetate at room temperature. The mixture was heated in an oil-bath at about 120° C. for about 22 hours while stirring vigorously. The reaction mixture was allowed to cool to about room temperature and poured into ice-water (100 ml). The precipitate was collected by filtration, washed with water, and dried to give a crude product. The crude product was heated with 50 ml of methanol to reflux and filtered to remove unwanted side-products. The filtrate was concentrated, 100 ml of water was added, and the residue was heated to reflux. Upon cooling, the precipitate was collected by filtration, washed with water, and dried to provide DAFO (3.95 g, 53%). Of course, any suitable materials may be used in place of or in addition to the materials described in Method G, as would be understood by one of skill in the art upon reading the present descriptions.

According to another method (Method H), AOCA (2.0 g, 14.0 mmol) was suspended in 15 ml of butyl acetate. Zinc chloride (3.9 g, 28 mmol) was added in one portion and the mixture was warmed to about 50° C. to provide a clear solution. ACOD (2.0 g, 18.2 mmol) was added in one portion, following by sulfuric acid (0.35 ml, ~7.0 mmol) and the mixture was heated at about 120° C. for about 1.0 hour while stirring vigorously. The solvent was removed under vacuum and the residue was treated using 100 ml ice-water. The precipitate was collected by filtration and washed by water. The solid was then heated with 100 ml of water to reflux, cooled to room temperature, and the precipitate was collected by suction filtration, washed by water, and dried by suction to provide DAFO (1.88 g, 57%). Of course, any suitable materials may be used in place of or in addition to the materials described in Method H, as would be understood by one of skill in the art upon reading the present descriptions.

According to another method (Method I), AOCA (0.5 g, 3.5 mmol) was suspended in 4.0 ml of butyl acetate. To this was added zinc chloride (0.97 g, 7.0 mmol) in one portion and the mixture was warmed to about 50° C. to provide a clear solution. ACOD (0.5 g, 4.5 mmol) was added in one portion, following by polyphosphorous acid ($H_3PO_3$, 0.45 g, ~7.0 mmol). The mixture was heated at about 120° C. for about 1 hour while stirring vigorously. The solvent was removed using a rotary evaporator and the residue was treated with 100 ml ice-water. The precipitate was collected by filtration and washed by water. The solid was heated with 30 ml of water to reflux, cooled to about room temperature, and the precipitate was collected by filtration, washed by water, and dried by suction to provide DAFO (0.27 g, 33%). Of course, any suitable materials may be used in place of or in addition to the materials described in Method I, as would be understood by one of skill in the art upon reading the present descriptions.

According to another method (Method J), AOCA (13.0 g, 90.9 mmol) and zinc chloride (20.0 g, 144.6 mmol) were suspended in 100 ml of butyl acetate. The mixture was warmed to 50° C. to provide a clear solution. ACOD (15.0 g, 136.4 mmol) was added in one portion and the mixture was stirred at temperature for about 5 minutes. Then, the mixture was cooled down to about 20-25° C. At this temperature precipitate appeared. With the cool water bath, hydrogen bromide (HBr) gas was introduced, keeping the reaction temperature at less than about 35° C. When the mixture turned to a clear solution, hydrogen bromide gas was stopped being introduced and the mixture was heated using a pre-heated oil bath at about 120° C. for about 1.0 hour while stirring vigorously. The solvent was removed using a rotary evaporator and the residue was treated with 500 ml of ice-water. The precipitate was collected by filtration and washed by water. The solid was heated with 200 ml of water to reflux, filtered hot, washed with hot water, and dried by suction to provide DAFO (13.4 g, 62%). Of course, any suitable materials may be used in place of or in addition to the materials described in Method J, as would be understood by one of skill in the art upon reading the present descriptions.

According to one embodiment, DNFO and/or ANFO may be prepared using the following reaction sequence or modification thereof, as would be understood by one of skill in the art upon reading the present descriptions.

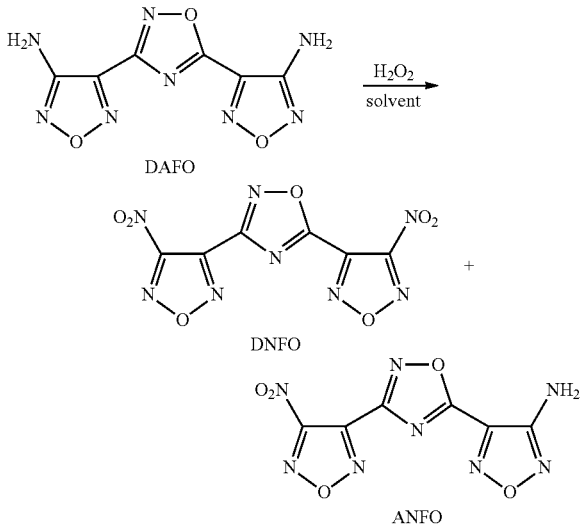

In a first method (Method K), trifluoroacetic acid (TFA, $CF_3CO_2H$, 60 ml) was placed in a 250 ml three-necked round bottom flask equipped with a magnetic stirrer, thermometer, and addition funnel. DAFO (10 g, 0.042 mol) was added in one portion at about room temperature while the flask was cooled with a water bath at less than about 20° C. Hydrogen peroxide ($H_2O_2$, 70% aqueous solution, 20.0 ml, 0.49 mol) was added dropwise via an addition funnel, keeping the reaction temperature below about 25° C. After the addition was completed, the reaction mixture was allowed to stir overnight at room temperature in the water bath for about 20 hours. The reaction mixture was poured over ice-water (300 g) and the product was extracted with methylene chloride ($CH_2Cl_2$) (3×100 ml). The combined organic phase was washed with water (2×100 ml), 10% aqueous sodium sulfite ($NaHSO_3$, 2×50 ml), water (2×100 ml), and dried over sodium sulfate. The methylene chloride was removed under vacuum and the residue was treated by short column chromatography (silica gel, ~70 g), eluting with methylene chloride/pentane (in about a 2:3 ratio) to provide DNFO (7.5 g, 60%). Further elution with methylene chloride provided ANFO (140 mg, 1.2%) as a white solid.

DNFO may be further purified by vacuum sublimation at 100° C./0.01 Ton and/or recrystallized from chloroform as a white crystalline compound, m.p. 60-62° C.; IR (thin layer, ν, $cm^{-1}$) 1571 (s), 1363 (ms), 1302 (ins), 1128 (ins), 1128 (ins) 979 (s), 824 (s); $^{13}$CNMR (DMSO-$d_6$) δ 164.0, 158.5, 158.5, 157.9, 138.6, 136.9; GC-MS (EI, m/z), 296 ($M^+$, 5%), 250 ($M^+$ —$NO_2$, 17%, 266 ($M^+$ —NO, 8%), 114 ($C_2N_3O_3^+$, 35%).

ANFO was further purified by recrystallization from ethanol. ANFO is a white crystalline compound, m.p. 92-93° C.; IR (KBr, ν, $cm^{-1}$) 3439 (s), 3410 (s), 3318 (s), 1643 (s), 1620 (s), 1565 (s), 1489 (s), 1337 (s), 1137 (s), 1101 (s), 1037 (s), 918 (in), 826 (s); $^1$HNMR (acetone-$d_6$) δ 6.24 (s); $^{13}$CNMR (acetone-$d_6$) δ 168.4, 160.4, 158.3, 156.4, 140.8, 135.4.

Of course, any suitable materials may be used in place of or in addition to the materials described in Method K, as would be understood by one of skill in the art upon reading the present descriptions.

In another method (Method L), DAFO (1.0 g, 4.23 mmol) was suspended in 10 ml of sulfuric acid (95-98%) at room temperature. While cooling using a water bath (10-20° C.), hydrogen peroxide (70% aqueous solution, 2.0 ml, ~49 mmol) was added dropwise. The mixture was allowed to stir at about 20° C. (immersed in a room temperature water bath) for about 22 hours. The reaction mixture was poured into ice-water and the product was extracted with methylene chloride (3×50 ml). The combined organic phase was washed with water and dried over sodium sulfate. The solvent was removed using a rotary evaporator and the residue was subjected to column chromatography (silica gel, methylene chloride) to provide DNFO (0.15 g, 12%). Of course, any suitable materials may be used in place of or in addition to the materials described in Method L, as would be understood by one of skill in the art upon reading the present descriptions.

In another method (Method M), DAFO (0.5 g, 2.1 mmol) was stirred in a mixture of 2.0 ml of sulfuric acid (95-98%) and 2.0 ml of trifluoroacetic acid at about room temperature. While cooling using a water bath (10-20° C.), hydrogen peroxide (70% aqueous solution, 1.0 ml, ~26 mmol) was added dropwise. The mixture was allowed to stir at about 20° C. (immersed in a room temperature water bath) for about 5 hours. The reaction mixture was poured over ice-water and the product was extracted with methylene chloride (3×30 ml). The combined organic phase was washed with water and dried over sodium sulfate. The solvent was removed using a rotary evaporator and the residue was subjected to column chromatography (silica gel, methylene chloride) to provide DNFO (0.28 g, 44%). Of course, any suitable materials may be used in place of or in addition to the materials described in Method M, as would be understood by one of skill in the art upon reading the present descriptions.

In another method (Method N), sulfuric acid (1.0 ml) was added carefully to hydrogen peroxide (50%, 2.0 ml) at less than about 10° C. After the addition was completed, the mixture was stirred at about 0-5° C. for about 1 hour. DAFO (0.50 g, 2.10 mmol) was added in several portions while stirring vigorously. The mixture was allowed to warm slowly to room temperature overnight, about 22 hours. The reaction mixture was poured over ice-water and extracted with methylene chloride (3×30 ml). The combined organic phase was washed with water and dried over sodium sulfate. The solvent was removed under vacuum and the residue was subjected to column chromatography (silica gel, methylene chloride) to provide DNFO (55 mg, 9%). Of course, any suitable materials may be used in place of or in addition to the materials described in Method N, as would be understood by one of skill in the art upon reading the present descriptions.

There are several possible uses of DNFO as a metal-loaded explosive. Because DNFO has a higher Chapman-Jouguet (C-J) detonation temperature than TNT, it may be a more effective thermobaric explosive when aluminum, boron, magnesium, or any other zero valence metal is added thereto. As a melt-castable explosive, DNFO may be a higher power alternative to TNT. The higher power will result in either weapon miniaturization or greater power from the same weapon configuration. Especially interesting may be an application in which boron is added to DNFO, a zero-hydrogen explosive, to fully combust the boron to $B_2O_3$. Because mixtures (e.g., eutectics) of DNFO with other low-melting explosives may be a liquid at room temperature, the mixture may be used as an energetic plasticizer in various explosive and propellant formulations, which may have a plurality of applications. These mixtures may be used as a replacement for other liquid energetic plasticizers, such as nitroglycerine (NG), trimethylolethane trinitrate (TMETN), ethylene glycol dinitrate (EGDN), etc. A mixture using DNFO as an energetic plasticizer has advantages over nitrate ester plasticizers in that it is more thermally stable and does not require any stabilizers. A high-power plasticizer with good thermal properties may be used in both rocket and weapon propellants to increase the performance, sensitivity, and range of the rocket and/or weapon. Because of the high-oxygen balance of DNFO, it may also have applications as an oxidizer in high-energy propellants (e.g., as a replacement for RDX).

ANFO is an insensitive energetic compound that has a melting point of about 92° C. to about 93° C. It may be used as a replacement for TNT or other explosives in melt-castable systems and as an ingredient for insensitive enhanced blast explosives or insensitive propellants, among other uses.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A melt-castable energetic material, comprising at least one of:

3,5-bis(4-nitro-1,2,5-oxadiazol-3-yl)-1,2,4-oxadiazole (DNFO); and 3-(4-amino-1,2,5-oxadiazol-3-yl)-5-(4-nitro-1,2,5-oxadiazol-3-yl)-1,2,4-oxadiazole (ANFO), wherein DNFO has a chemical structure of:

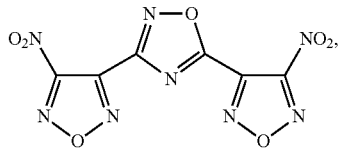

and wherein ANFO has a chemical structure of:

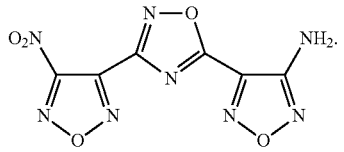

2. The melt-castable energetic material as recited in claim 1, comprising both ANFO and DNFO.

3. The melt-castable energetic material as recited in claim 1, further comprising a metal selected from a group consisting of: aluminum, boron, and magnesium.

4. An article, comprising:

a housing for directing an explosion; and the melt-castable energetic material as recited in claim 1 for providing the explosion.

5. The article as recited in claim 4, wherein the melt-castable energetic material further comprises a zero valence metal.

6. A method for forming the melt-castable energetic material as recited in claim 1, the method comprising:

reacting 3,5-bis(4-amino-1,2,5-oxadiazol-3-yl)-1,2,4-oxadiazole (DAFO) with oxygen or an oxygen-containing compound to form a mixture of at least:

the 3,5-bis(4-nitro-1,2,5-oxadiazol-3-yl)-1,2,4-oxadiazole (DNFO); and the 3-(4-amino-1,2,5-oxadiazol-3-yl)-5-(4-nitro-1,2,5-oxadiazol-3-yl)-1,2,4-oxadiazole (ANFO), wherein the DNFO has a chemical structure of:

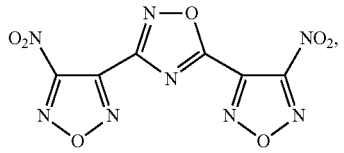

wherein the ANFO has a chemical structure of:

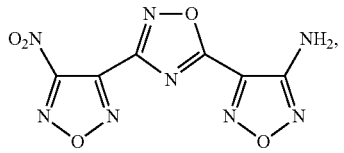

and wherein the DAFO has a chemical structure of:

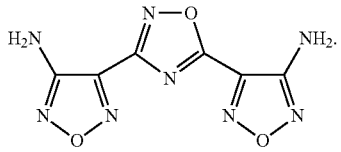

7. The method as recited in claim 6, further comprising:

forming the DAFO by reacting 4-amino-1,2,5-oxadiazole-3-carboxamidoxime (AOCA) and 3-amino-4-cyano-1,2,5-oxadiazole (ACOD) with an acid, wherein the AOCA has a chemical structure of:

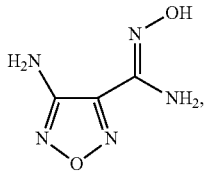

and wherein the COD has a chemical structure of:

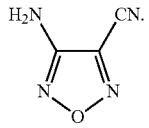

8. The method as recited in claim 7, wherein the acid comprises zinc chloride ($ZnCl_2$).

9. The method as recited in claim 6, wherein the reacting with oxygen comprises:

mixing the DAFO with a solvent, wherein the solvent is chosen from a group consisting of: trifluoroacetic acid (TFA) and sulfuric acid; and adding a 50%-90% hydrogen peroxide ($H_2O_2$) solution to the DAFO and the solvent to form a reaction solution.

10. The method as recited in claim 9, further comprising cooling the reaction solution to maintain a temperature of less than about 50° C. while stirring the reaction solution for a period of at least 8 hours.

11. The method as recited in claim 6, further comprising:

extracting the DNFO and the ANFO using an organic solvent;

separating the DNFO using short column chromatography while eluting with a methylene chloride ($CH_2Cl_2$) and pentane ($C_5H_{12}$) solution in about a 2:3 ratio; and separating the ANFO using short column chromatography while eluting with methylene chloride.

12. The method as recited in claim 9, wherein the organic solvent comprises at least one of: methylene chloride, toluene ($C_6H_5CH_3$), ether ($CH_3$—$CH_2$—O—$CH_2$—$CH_3$ or R—O—R', wherein R and R' are an alkyl group or an aryl group), and ethyl acetate ($CH_3COOCH_2CH_3$).

13. The method as recited in claim 9, further comprising:

purifying the DNFO using at least one of: vacuum sublimation and recrystallization from chloroform ($CHCl_3$); and purifying the ANFO using recrystallization from ethanol ($C_2H_5OH$).

14. The method as recited in claim 6, further comprising purifying the DNFO using at least one of: vacuum sublimation and recrystallization.

15. The method as recited in claim 6, wherein the reacting with oxygen comprises:

suspending the DAFO in an acid, wherein the acid is chosen from a group consisting of: trifluoroacetic acid (TFA) and sulfuric acid; and adding a 50%-90% hydrogen peroxide ($H_2O_2$) solution to the DAFO and the acid to form a reaction solution.

16. The method as recited in claim 15, further comprising cooling the reaction solution to maintain a temperature of less than about 50° C. while stirring the reaction solution for a period of at least 8 hours.

17. The method as recited in claim 15, further comprising:

adding the reaction solution to water at a temperature of less than about 5° C.;

extracting the DNFO and the ANFO using methylene chloride to provide a product;

washing the product with water;

drying the product over sodium sulfate;

removing solvent from the product using a rotary evaporator; and separating the DNFO using column chromatography while eluting with methylene chloride.

18. The method as recited in claim 6, wherein the reacting further comprises adding a zero valence metal to the mixture such that at least one of the DNFO and the ANFO becomes metal-loaded.

* * * * *